US009926044B1

(12) United States Patent
Su

(10) Patent No.: US 9,926,044 B1
(45) Date of Patent: Mar. 27, 2018

(54) FULL CONTACT PONTOON FLOATING DECK

(71) Applicant: FLOAT-TEK INTERNATIONAL CO., LTD., Tainan (TW)

(72) Inventor: Chin-Fa Su, Tainan (TW)

(73) Assignee: Float-Tek International Co., Ltd., Tainan (TW)

( * ) Notice: Subject to any disclaimer, the term of this patent is extended or adjusted under 35 U.S.C. 154(b) by 0 days.

(21) Appl. No.: 15/597,256

(22) Filed: May 17, 2017

(51) Int. Cl.

| | |
|---|---|
| ***B63B 3/48*** | (2006.01) |
| ***B65D 88/34*** | (2006.01) |
| ***B63B 35/34*** | (2006.01) |
| ***B63B 1/12*** | (2006.01) |

(52) U.S. Cl.
CPC ..... *B63B 3/48* (2013.01); *B63B 1/121* (2013.01); *B63B 35/34* (2013.01); *B65D 88/34* (2013.01)

(58) Field of Classification Search
CPC ..... B65D 88/34; B65D 88/00; B65D 88/36; B65D 88/40; B65D 88/42; F16B 5/00; F16B 5/004
USPC ..... 114/292; 220/216, 219, 222, 225
See application file for complete search history.

(56) References Cited

U.S. PATENT DOCUMENTS

| | | | | |
|---|---|---|---|---|
| 5,704,509 A * | 1/1998 | Rosenkrantz | ..... | B65D 88/34 220/216 |
| 8,973,771 B2 * | 3/2015 | Doxey | ..... | B65D 88/34 220/216 |
| 9,267,521 B2 * | 2/2016 | Baillie | ..... | F16B 5/004 |

* cited by examiner

*Primary Examiner* — Lars A Olson
(74) *Attorney, Agent, or Firm* — Rosenberg, Klein & Lee

(57) ABSTRACT

A full contact pontoon floating deck is revealed. An upper and a lower assembly grooves are disposed concavely on an upper and a lower ends of each of two sides of a pontoon respectively. A connecting rod is connected to the two pontoons by upper connecting members and lower connecting members. One end of the upper connecting member and one end of the lower connecting member are connected to the upper and the lower assembly grooves of the pontoon respectively by upper and lower assembly members while an upper and a lower connecting portions on the other end of the upper and the lower connecting members are connected to an upper and a lower connecting grooves of the connecting rod respectively. Thereby the tight connection forms a fully-sealed design with good support strength. No vapor space is formed so that environmental requirements are met.

2 Claims, 8 Drawing Sheets

FULL CONTACT PONTOON FLOATING DECK

BACKGROUND OF THE INVENTION

Field of the Invention

The present invention relates to a full contact pontoon floating deck, especially to a full contact pontoon floating deck with a fully-sealed design and excellent support strength. Moreover, the no vapor space design not only ensures the sealing effect but also meets the environmental requirements.

Description of Related Art

Generally, an oil tank is not only including a hollow tank for storage of liquid/fuel but also equipped with a floating deck that raises or lowers on liquid/fuel surface. The floating deck is not only used for sealing top surface of the liquid/fuel in the tank and reducing evaporative losses of liquid/petroleum evaporation but also allowing operators to walk thereon for repair and maintenance. The floating deck is divided into two types.

The first type is the pontoon floating deck. There is a vapor space between the floating tube and the fuel surface so that liquid/petroleum is easily evaporated and emitted.

The other one is the honeycomb floating deck. Yet the honeycomb panels are bonded and fixed by adhesives. After long-term use in the oil tank filled with gasoline vapor, the adhesive is easy to have chemical changes and the honeycomb panels are gradually broken down. The connection of the honeycomb panels is getting poor.

Thus there is room for improvement and there is a need to provide a full contact pontoon floating deck that overcomes the shortcomings mentioned above and provides a higher practical value.

SUMMARY OF THE INVENTION

Therefore it is a primary object of the present invention to provide a full contact pontoon floating deck including a plurality of pontoons connected by connecting rods. The pontoons and the connecting rods are connected and fixed firmly so as to provide a fully-sealed design and excellent support strength. No vapor space is formed so that environmental requirements are met. More importantly, the no vapor space design not only ensures the sealing effect but also meets the environmental requirements.

In order to achieve the above object, a full contact pontoon floating deck according to the present invention mainly includes at least two pontoons and at least one connecting rod.

The pontoon is a hollow tube with a rectangular cross section. An upper assembly groove and a lower assembly groove are arranged concavely on an upper end and a lower end of each of two sides of the pontoon respectively. An end cover is connected to and fixed on each of two ends of the pontoon by welding and is used for sealing the pontoon.

An upper connecting groove is mounted on a middle part of a top end of the connecting rod and two lower connecting grooves are disposed on a bottom end of each of two sides of the connecting rod respectively and correspondingly. The upper connecting groove is mounted with upper connecting members. One end of the of the upper connecting member is connected to the upper assembly groove of the pontoon by an upper assembly member while an upper connecting portion formed on the other end thereof is mounted in and connected to the upper connecting groove. The lower connecting groove is arranged with a lower connecting member. One end of the lower connecting member is connected to the lower assembly groove of the pontoon by a lower assembly member while a lower connecting portion formed on the other end thereof is mounted in and connected to the lower connecting groove.

An upper connecting piece is extended from a top end of the end cover while an upper mounting portion is arranged at the upper connecting piece for being connected to the upper connecting groove of the connecting rod. A lower connecting piece is extended from a bottom end of the end cover and used for being fixed on a lower edge of the connecting rod by a fixing member.

The connecting rod further includes an upper plate. A mounting projection corresponding to the upper connecting groove is projected from a middle part of the bottom of the upper plate. The mounting projection of the upper plate is used to be mounted in and positioned by the upper connecting groove. A fastener is passed through the top end of the upper plate and the mounting projection to be fixed in the upper connecting groove.

A full contact pontoon floating deck according to the present invention mainly includes at least two pontoons and at least one connecting rod. The pontoon is a hollow tube with a rectangular cross section. An upper end and a lower end of each of two sides of the pontoon are arranged concavely with an upper assembly groove and a lower assembly groove respectively. Each of two ends of the pontoon is fixed with an end cover by welding and the end cover is used for sealing the pontoon. A top end of the connecting rod is a flat surface. A lower connecting groove is arranged at a bottom end of each of two sides of the connecting rod correspondingly. A lower connecting member is set on the lower connecting groove. One end of the lower connecting member is connected to the lower assembly groove of the pontoon by a lower assembly member while the lower connecting portion formed on the other end thereof is mounted in and connected to the lower connecting groove. The connecting rod further includes an upper plate that is fastened with and connected to the upper assembly groove of the pontoon by a fastener.

A full contact pontoon floating deck according to the present invention mainly includes at least two pontoons and at least one connecting rod. The pontoon is a hollow tube with a rectangular cross section. An upper end and a lower end of each of two sides of the pontoon are arranged concavely with an upper assembly groove and a lower assembly groove respectively. Each of two ends of the pontoon is fixed with an end cover by welding and the end cover is used for sealing the pontoon. A top surface of the connecting rod is extended toward two sides thereof to form two upper connecting members integrally. The upper connecting member is connected to the upper assembly groove of the pontoon by an upper assembly member. A bottom end of each of the two sides of the connecting rod is directly extended outward to form two lower connecting members. The lower connecting member is connected to the lower assembly groove of the pontoon by a lower assembly member.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
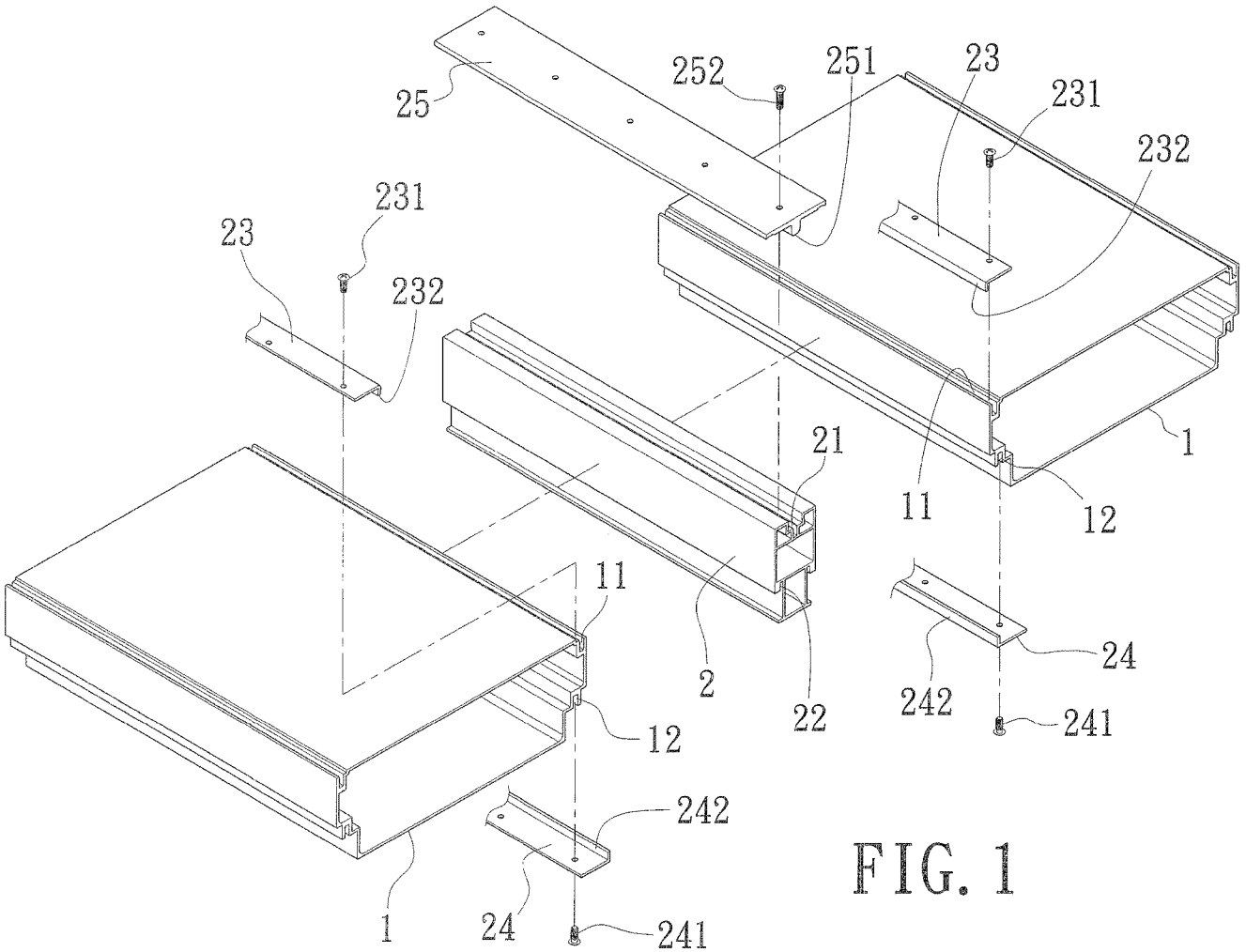
FIG. 1 is an explosive view of an embodiment according to the present invention.

A full contact pontoon type floating deck of the present invention mainly includes at least two pontoons 1 and at least one connecting rod 2.

The pontoon 1 is a hollow tube with a rectangular cross section. An upper assembly groove 11 is arranged concavely on an upper end of each of two sides of the pontoon 1 and a lower assembly groove 12 is disposed concavely on a bottom end of each of the two sides of the pontoon 1.

The connecting rod 2 includes an upper connecting groove 21, two lower connecting grooves 22, two upper connecting members 23, two lower connecting members 24, and an upper plate 25. The upper connecting groove 21 is mounted on a middle part of a top end of the connecting rod 2 and the lower connecting grooves 22 are disposed on a bottom end of each of two sides of the connecting rod 2 respectively and correspondingly while the upper connecting members 23 are set correspondingly to the upper connecting groove 21. One end of the upper connecting member 23 is connected to the upper assembly groove 11 of the pontoon 1 by an upper assembly member 231 while an upper connecting portion 232 formed on the other end thereof is mounted in and connected to the upper connecting groove 21. The lower connecting members 24 are arranged at the lower connecting groove 22 respectively and correspondingly. One end of the lower connecting member 24 is connected to the lower assembly groove 12 of the pontoon 1 by a lower assembly member 241 while a lower connecting portion 242 formed on the other end thereof is mounted in and connected to the lower connecting groove 22. A mounting projection 251 corresponding to the upper connecting groove 21 is projected from a middle part of the bottom of the upper plate 25. The upper plate 25 is positioned on the upper connecting groove 21 by the mounting projection 251 being mounted in the upper connecting groove 21 and a fastener 252 passed through the top end of the upper plate 25 and the mounting projection 251 to be fixed in the upper connecting groove 21. The upper plate 25 is used to cover the upper connecting member 23 as well as the upper assembly member 231.

Figure 2:
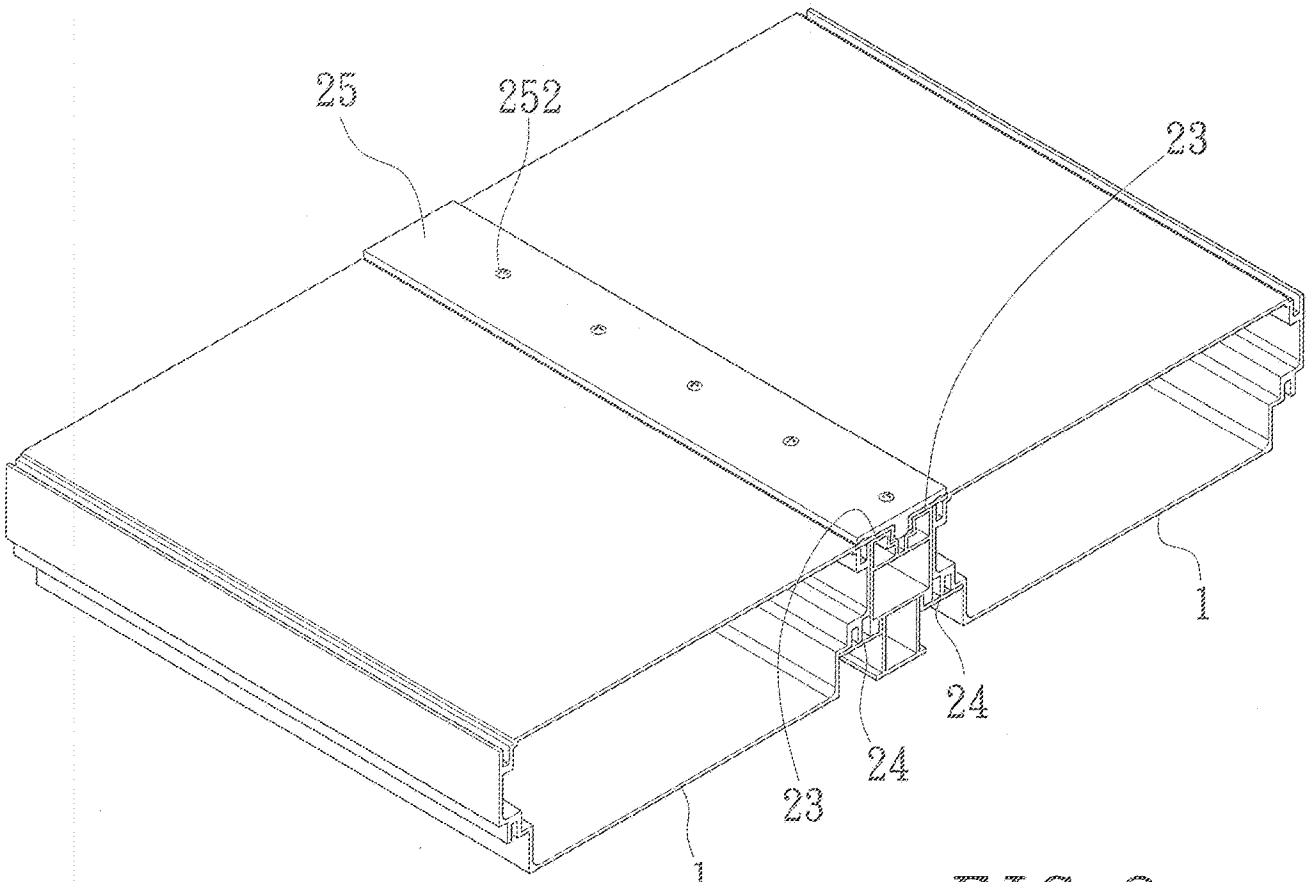
FIG. 2 is a perspective view of an embodiment according to the present invention.
Figure 3:
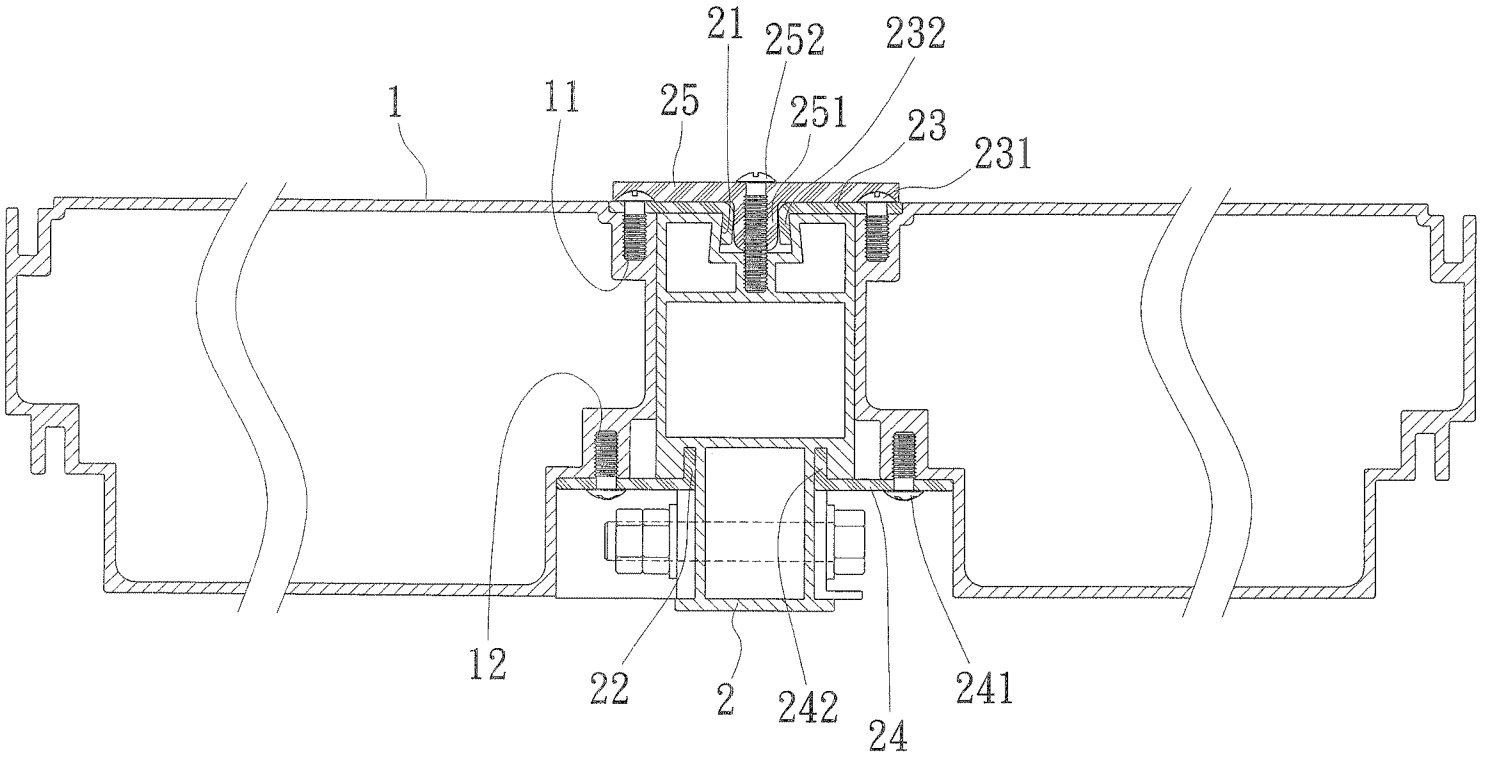
FIG. 3 is a longitudinal sectional view of an embodiment according to the present invention.
Figure 4:
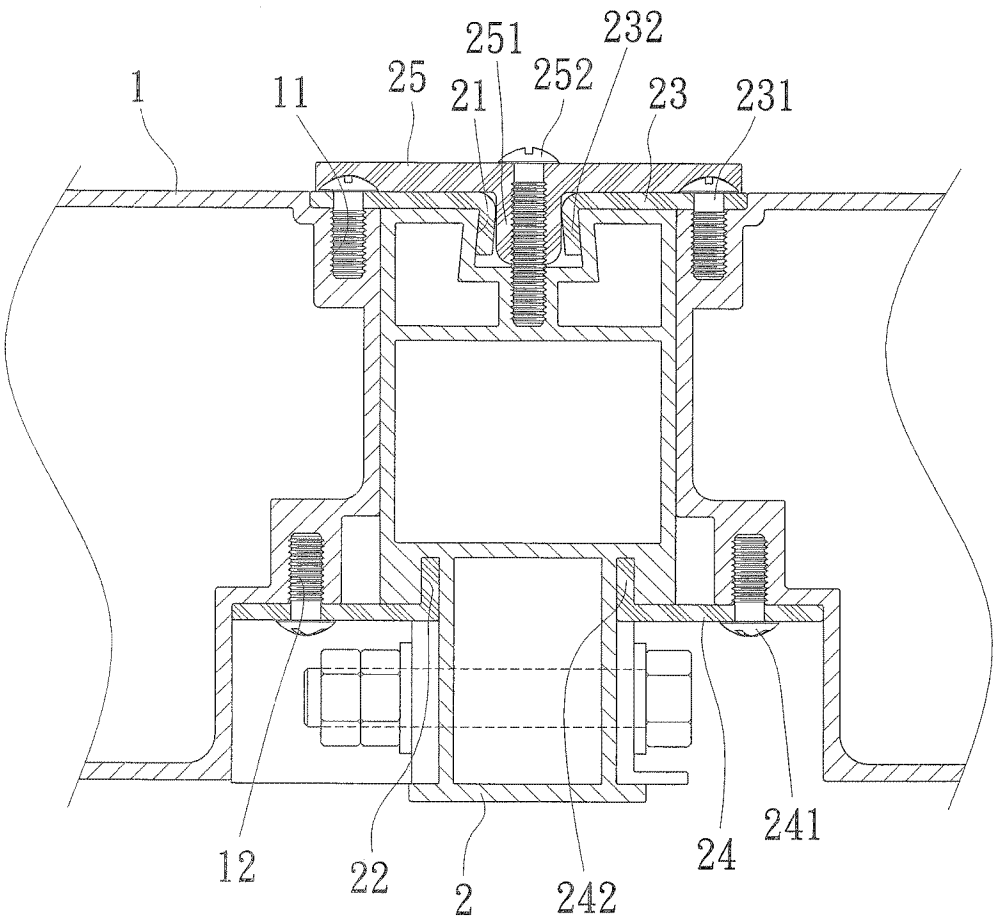
FIG. 4 is a partial enlarged sectional view of an embodiment according to the present invention.
Figure 5:
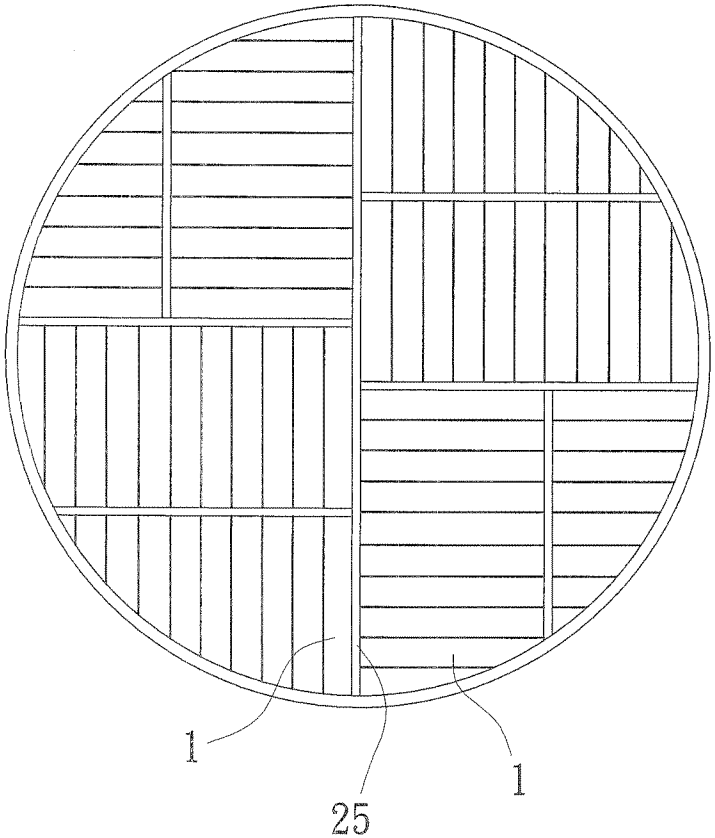
FIG. 5 is a schematic drawing showing

Refer to FIG. 2 and FIG. 3, the connecting rod 2 is set between the two pontoons 1. First one end of the upper connecting member 23 is connected to the upper assembly groove 11 of the pontoon 1 by the upper assembly member 231 while the upper connecting portion 232 of the upper connecting member 23 is mounted in and connected to the upper connecting groove 21 of the connecting rod 2. One end of the lower connecting member 24 is also connected to the lower assembly groove 12 of the pontoon 1 by the lower assembly member 241 while the lower connecting portion 242 of the lower connecting member 24 is mounted in and connected to the lower connecting groove 22 of the connecting rod 2. Then the mounting projection 251 of the upper plate 25 is mounted in and positioned by the upper connecting groove 21. Next the fastener 252 is fastened and fixed into the upper connecting groove 21 by passing through the top end of the upper plate 25 and the mounting projection 251. Thus the upper connecting member 23 together with the upper assembly member 231 is covered by the upper plate 25 (also refer to FIG. 4). Therefore the connecting rods 2 are used to connect a plurality of pontoons 1 to form a floating deck. Refer to FIG. 5, the floating deck is floated and covered over the surface of the stored liquid.

Figure 6:
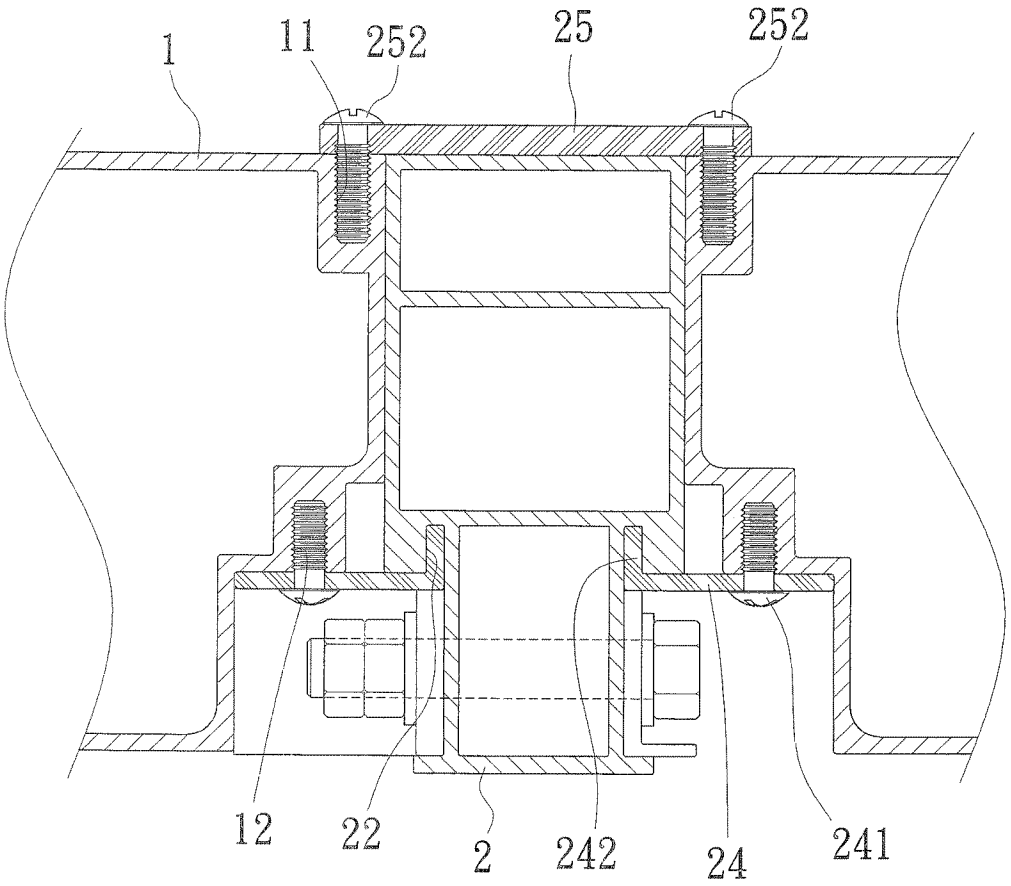
FIG. 6 is a schematic drawing showing a longitudinal sectional view of an embodiment according to the present invention.

Refer to FIG. 6, a top end of the connecting rod 2 in another embodiment is flat. Two lower connecting grooves 22 are arranged at a bottom end of each of two sides of the connecting rod 2 respectively and corresponding to each other. A lower connecting member 24 is disposed on the lower connecting groove 22. One end of the lower connecting member 24 is connected to the lower assembly groove 12 of the pontoon 1 by a lower assembly member 241 while the lower connecting portion 242 formed on the other end thereof is mounted in and connected to the lower connecting groove 22. The connecting rod 2 further includes an upper plate 25 that is fastened with and connected to the upper assembly groove 11 of the pontoon 1 by a fastener 252. Thus the connecting rods 2 are used to connect a plurality of pontoons 1 for construction of a floating deck that rests on the liquid surface.

Figure 7:
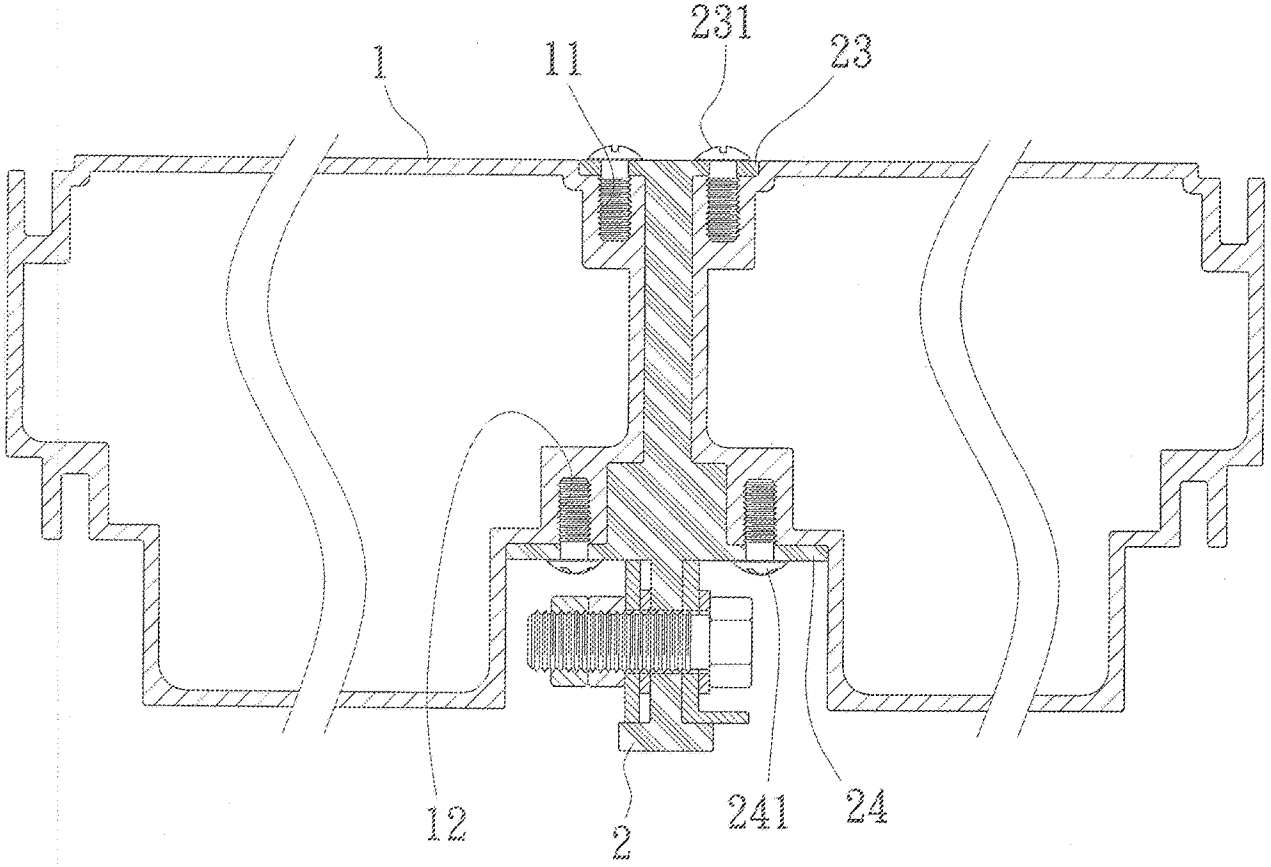
FIG. 7 is a schematic drawing showing a longitudinal sectional view of another embodiment according to the present invention.

Refer to FIG. 7, a further embodiment is revealed. A top surface of the connecting rod 2 is extended toward two sides thereof to form two upper connecting members 23 integrally. The upper connecting member 23 is connected to the upper assembly groove 11 of the pontoon 1 by an upper assembly member 231. A bottom end of each of two sides of the connecting rod 2 is directly extended outward to form two lower connecting members 24. The lower connecting member 24 is connected to the lower assembly groove 12 of the pontoon 1 by a lower assembly member 241. Similarly, the connecting rods 2 of this embodiment are also used to join a plurality of pontoons 1 for forming a floating deck set on the surface of the stored liquid.

Figure 8:
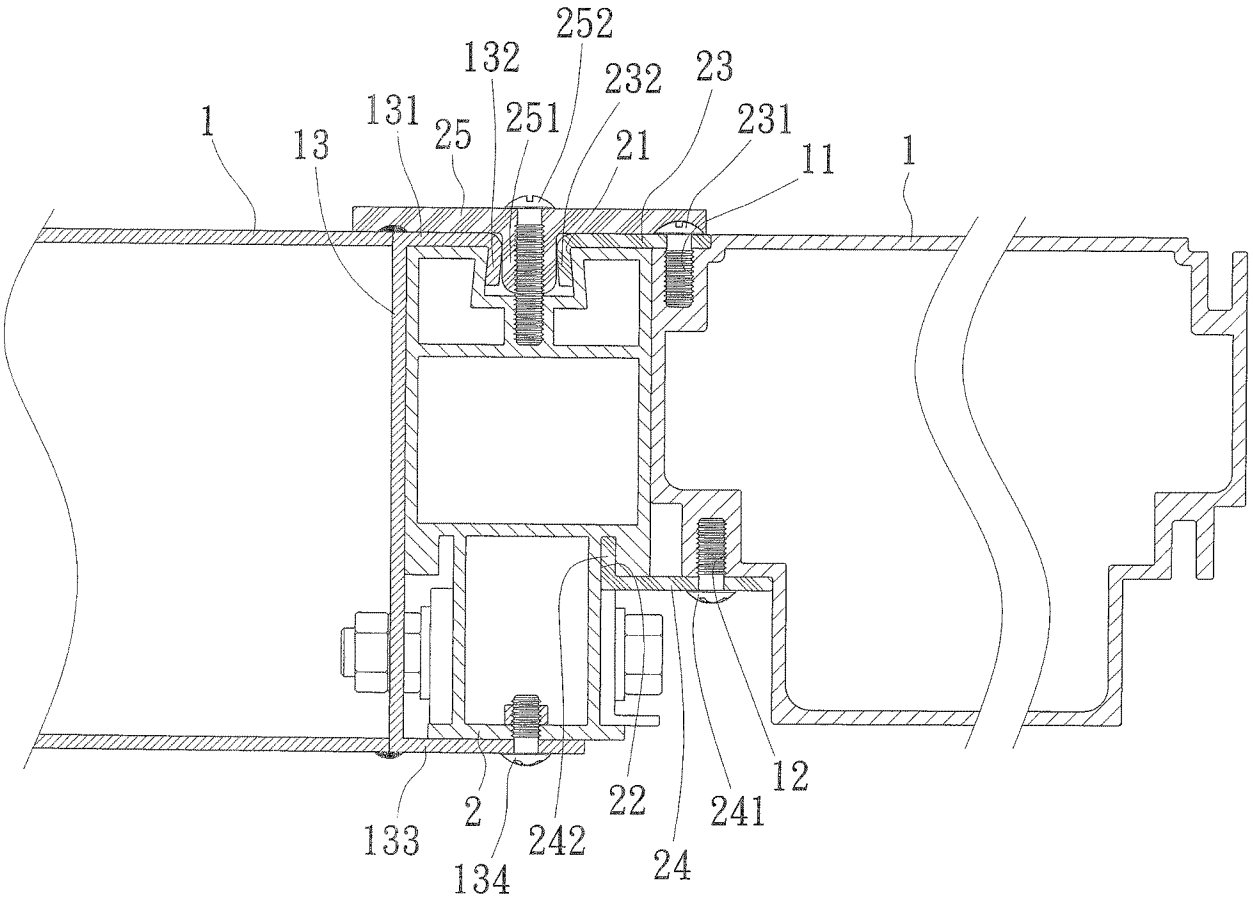
FIG. 8 is a schematic drawing showing a longitudinal sectional view of a further embodiment according to the present invention.

Refer to FIG. 8, a further embodiment is revealed. Each of two ends of the pontoon 1 is connected to and fixed with an end cover 13 by welding. The end cover 13 is used for sealing the pontoon 1. An upper connecting piece 131 is extended from a top end of the end cover 13 while an upper mounting portion 132 is set on the upper connecting piece 131 for being connected to and mounted in the upper connecting groove 21 of the connecting rod 2. A bottom end of the end cove 13 is extended to form a lower connecting piece 133 that is fixed on a lower edge of the connecting rod 2 by a fixing member 134. Thus the two ends of the pontoon 1 are connected to the connecting rod 2. The floating deck can be constructed by the pontoons 1 and the connecting rods 2 connected in different manners.

While in use, users can directly connect and fix a plurality of pontoons 1 on a bottom surface of a board for floating on the surface of the stored liquid.

In summary, the floating deck of the present invention includes a plurality of the pontoons connected by the connecting rods. Compared with the structure available now, the components of the floating deck of the present invention are not only tightly connected and firmly fixed, but also providing a fully-sealed design and excellent support strength. The most important feature of the present invention is no vapor space between the floating deck and the liquid surface. Therefore the sealing effect of the floating deck is improved and the floating deck ensures compliance with environmental requirements.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A full contact pontoon floating deck comprising at least two pontoons and at least one connecting rod;

wherein each pontoon is a hollow tube with a rectangular cross section; an upper assembly groove and a lower assembly groove are respectively arranged concavely on an upper end and a lower end of each of two sides of each pontoon; and wherein an upper connecting groove is mounted on a middle part of a top end of the connecting rod and two lower connecting grooves are disposed on a bottom end of each side of the connecting rod respectively and correspondingly; the upper connecting groove is mounted with at least two upper connecting members; one end of each upper connecting member is connected to the upper assembly groove of a corresponding one of the at least two pontoons by an upper assembly member while an upper connecting portion formed on an opposing end of each upper connecting member is mounted in and connected to the upper connecting groove of the connecting rod; the lower connecting groove is arranged with at least one lower connecting member; one end of the lower connecting member is connected to the lower assembly groove of the pontoon by a lower assembly member while a lower connecting portion formed on the other end thereof is mounted in and connected to the lower connecting groove.

2. The device as claimed in claim 1, wherein the connecting rod further includes an upper plate; a mounting projection corresponding to the upper connecting groove is projected from a middle part of a bottom of the upper plate; the mounting projection of the upper plate is used to be mounted in and positioned by the upper connecting groove; a fastener is passed through the top end of the upper plate and the mounting projection to be fixed in the upper connecting groove.

* * * * *